US010814366B2

(12) United States Patent
Kim et al.

(10) Patent No.: US 10,814,366 B2
(45) Date of Patent: Oct. 27, 2020

(54) COIL WIDTH CONTROL METHOD AND APPARATUS

(71) Applicant: Hyundai Steel Company, Dong-gu (KR)

(72) Inventors: Dong Iel Kim, Jeollanam-do (KR); Sang Ju Kim, Chungcheongnam-do (KR); Hyeong Jin Kim, Jeollabuk-do (KR); Jeong An Seon, Gwangju-Si (KR); Ji Wung Jeong, Jeollabuk-do (KR)

(73) Assignee: Hyundai Steel Company, Incheon (KR)

( * ) Notice: Subject to any disclaimer, the term of this patent is extended or adjusted under 35 U.S.C. 154(b) by 386 days.

(21) Appl. No.: 15/914,841

(22) Filed: Mar. 7, 2018

(65) Prior Publication Data

US 2019/0201954 A1 Jul. 4, 2019

(30) Foreign Application Priority Data

Dec. 28, 2017 (KR) ..... 10-2017-0182434

(51) Int. Cl.
*C21D 11/00* (2006.01)
*B21B 37/16* (2006.01)
(Continued)

(52) U.S. Cl.
CPC ..... *B21B 37/16* (2013.01); *B21B 37/56* (2013.01); *B21B 37/58* (2013.01); *B21B 37/74* (2013.01);
(Continued)

(58) Field of Classification Search
CPC .... H02K 1/06; C23C 2/04; C23C 2/02; C21D 9/0081; C21D 11/005; C22C 38/02; B21D 22/208; B21B 45/08
See application file for complete search history.

(56) References Cited

U.S. PATENT DOCUMENTS 5,827,618 A * 10/1998 Oyagi ..... C23C 2/02 428/621
6,776,857 B2 * 8/2004 Lee ..... B21B 45/08 148/601
(Continued)

FOREIGN PATENT DOCUMENTS

JP 08-127820 A 5/1996
KR 10-2004-0019732 A 3/2004
KR 10-1230193 B1 5/2012

OTHER PUBLICATIONS

Office Action dated Mar. 14, 2019, issued in the corresponding Korean Patent Application No. 10-2017-0182434. (English annotated explanation of relevance is provided).

*Primary Examiner* — Kandasamy Thangavelu
(74) *Attorney, Agent, or Firm* — Locke Lord LLP; Daniel J. Fiorello; James E. Armstrong, IV

(57) ABSTRACT

Disclosed is a coil width control method including: a step in which a control unit generates a prediction model for predicting the width shrinkage of a coil, which occurs in the heat-treatment process and post-treatment process of a cold-rolled steel sheet production process, on the basis of historical operating results; a step in which the control unit receives the input width of the coil entering the heat-treatment process; and a step in which the control unit predicts the output width of the coil after the post-treatment process on the basis of the received input width and the conditions of the cold-rolled steel sheet production process, and controls in-furnace temperature and in-furnace tension of the heat-treatment process and elongation of the post-treatment process.

8 Claims, 6 Drawing Sheets

(51) Int. Cl.

| | |
|---|---|
| ***B21B 37/56*** | (2006.01) |
| ***B21B 37/58*** | (2006.01) |
| ***C21D 1/26*** | (2006.01) |
| ***C21D 9/56*** | (2006.01) |
| ***B21B 37/74*** | (2006.01) |

(52) U.S. Cl.
CPC ..... *C21D 1/26* (2013.01); *C21D 9/56* (2013.01); *C21D 9/564* (2013.01); *C21D 11/00* (2013.01)

(56) References Cited

U.S. PATENT DOCUMENTS

| | | | | |
|---|---|---|---|---|
| 2003/0196735 | A1* | 10/2003 | Sugiura | C22C 38/02 148/602 |
| 2008/0008901 | A1* | 1/2008 | Sugiura | C22C 38/14 428/639 |
| 2016/0076119 | A1* | 3/2016 | Linzer | C21D 11/005 148/503 |
| 2016/0369365 | A1* | 12/2016 | Hanamura | C21D 9/0081 |
| 2017/0240987 | A1* | 8/2017 | Nagoshi | H02K 1/06 |
| 2018/0171460 | A1* | 6/2018 | Tokuda | C23C 2/04 |
| 2019/0105700 | A1* | 4/2019 | Jimbo | B21D 22/208 |

* cited by examiner

COIL WIDTH CONTROL METHOD AND APPARATUS

CROSS-REFERENCE TO RELATED APPLICATION(S)

This application claims priority to Korean Patent Application No. 10-2017-0182434, filed on Dec. 28, 2017, the disclosure of which is incorporated herein by reference in its entirety.

BACKGROUND OF THE INVENTION

Field of the Invention

The present invention relates to a coil width control method and apparatus, and more particularly to a coil width control method and apparatus for controlling the width shrinkage of a coil, which occurs in the heat-treatment process and post-treatment process of a cold-rolled steel sheet production process.

Description of the Related Art

In general, a cold-rolled steel sheet production process refers to a process of making a rolled product, which has excellent thickness uniformity and a clean surface, at room temperature or a temperature below the recrystallization temperature of the metal. This cold-rolled steel sheet production process includes: a pickling process of removing surface scale from a hot-rolled coil as a raw material by pickling; a cold rolling process at room temperature; an annealing process in which heat treatment is performed; and a temper rolling process of correcting the shape of the sheet.

The annealing process in the cold-rolled steel sheet production process is a process in which a coil is heat-treated by a heat-treatment system including a heating section and a cooling section while it is moved by upper and lower transfer rolls. Heat treatment by the annealing process can increase the processability of the coil and enables the coil to be imparted with the glossiness and surface roughness suitable for the intended use.

In the annealing process, the coil is moved by transfer rolls while a suitable tension is applied to the transfer rolls in order to correct the shape and prevent meandering. In this process, as tension is applied to the coil at high temperatures and the repeated bending of the coil by the transfer rolls occurs, the lengthwise (movement direction) stretching of the coil by plastic deformation occurs, and thus widthwise shrinkage of the coil occurs.

A background art related to the present invention is disclosed in Korean Patent No. 10-1230193 (Feb. 6, 2013).

SUMMARY OF THE INVENTION

It is an object of the present invention to provide a coil width control method and apparatus which are configured to establish the quantitative correlation between the fluctuation of operating condition and the coil width shrinkage and automatically control operating conditions to control the coil width shrinkage in process procedures, thereby improving the inaccuracy of coil width control that has relied on the experience of operators.

A coil width control method according to one aspect of the present invention may include: a step in which a control unit generates a prediction model for predicting the width shrinkage of a coil, which occurs in the heat-treatment process and post-treatment process of a cold-rolled steel sheet production process, on the basis of historical operating results; a step in which the control unit receives the input width of the coil entering the heat-treatment process; and a step in which the control unit predicts the output width of the coil after the post-treatment process on the basis of the received input width and the conditions of the cold-rolled steel sheet production process, and controls in-furnace temperature and in-furnace tension of the heat-treatment process and elongation of the coil during the post-treatment process.

In the present invention, the prediction model may be a correlation model between operating conditions and coil width shrinkage, generated by regression analysis of the operating conditions through a least square method, wherein the operating conditions include the in-furnace temperature, the in-furnace tension and the coil elongation.

In the present invention, the step in which the control unit controls in-furnace temperature and in-furnace tension in the heat-treatment process and elongation in the post-treatment process may include: a step in which the control unit firstly predicts the output width of the corresponding coil on the basis of the received input width and the conditions of the cold-rolled steel sheet production process by use of a historical database (DB) and controls the in-furnace temperature on the basis of the firstly predicted output width and the prediction model, before the corresponding coil enters the heat-treatment process; a step in which the control unit secondly predicts the output width of the corresponding coil on the basis of current heat-treatment process conditions and controls the in-furnace tension on the basis of the secondly predicted output width and the prediction model, after the corresponding coil enters the heat-treatment process; and a step in which the control unit thirdly predicts the output width of the corresponding coil on the basis of current post-treatment process conditions and controls the elongation on the basis of the thirdly predicted output width and the prediction model, after the corresponding coil passes through the heat-treatment process.

In the present invention, in the step in which the control unit controls the elongation, the control unit may control the elongation by sequentially controlling the roll force of a skin pass mill and the roll force of a tension leveler.

The method according to the present invention may further include: a step in which the control unit receives the actual output width of the coil that passed through the post-treatment process; and a step in which the control unit updates the prediction model on the basis of a deviation between the predicted output width and the received actual output width.

A coil width control apparatus according to one aspect of the present invention may include: an input width measurement unit configured to measure the input width of a coil entering a heat-treatment process in a cold-rolled steel sheet production process including the heat-treatment process and a post-treatment process; a heat-treatment control unit configured to control in-furnace temperature and in-furnace tension in the heat-treatment process; a post-treatment control unit configured to control elongation in the post-treatment process; and a control unit configured to generate a prediction model for predicting the width shrinkage of the coil, which occurs in the heat-treatment process and the post-treatment process, on the basis of historical operating results, predict the output width of the coil after the post-treatment process on the basis of the input width received from the input width measurement unit and the conditions of the cold-rolled steel sheet production process, control the in-furnace temperature and the in-furnace tension through the heat-treatment control unit on the basis of the predicted output width and the prediction model, and control the elongation through the post-treatment control unit.

In the present invention, the control unit may be configured to: firstly predict the output width of the corresponding coil on the basis of the received input width and the conditions of the cold-rolled steel sheet production process by use of a historical database (DB) and previously predict the in-furnace temperature through the heat-treatment control unit on the basis of the firstly predicted output width and the prediction model, before the corresponding coil enters the heat-treatment process; secondly predict the output width of the corresponding coil on the basis of current heat-treatment process conditions and control the in-furnace tension through the heat-treatment control unit on the basis of the secondly predicted output width and the prediction model, after the corresponding coil enters the heat-treatment process; and thirdly predict the output width of the corresponding coil on the basis of current post-treatment process conditions, and control the elongation through the post-treatment control unit on the basis of the thirdly predicted output width and the prediction model, after the corresponding coil passes through the heat-treatment process.

In the present invention, the apparatus may further include an output width measurement unit configured to measure the output width of the coil that passed through the post-treatment process, and the control unit is configured to receive the actual output width of the coil, which passed through the post-treatment process, from the output width measurement unit, and update the prediction model on the basis of a deviation between the predicted output width and the received actual output width.

DESCRIPTION OF SPECIFIC EMBODIMENTS

Figure 1:
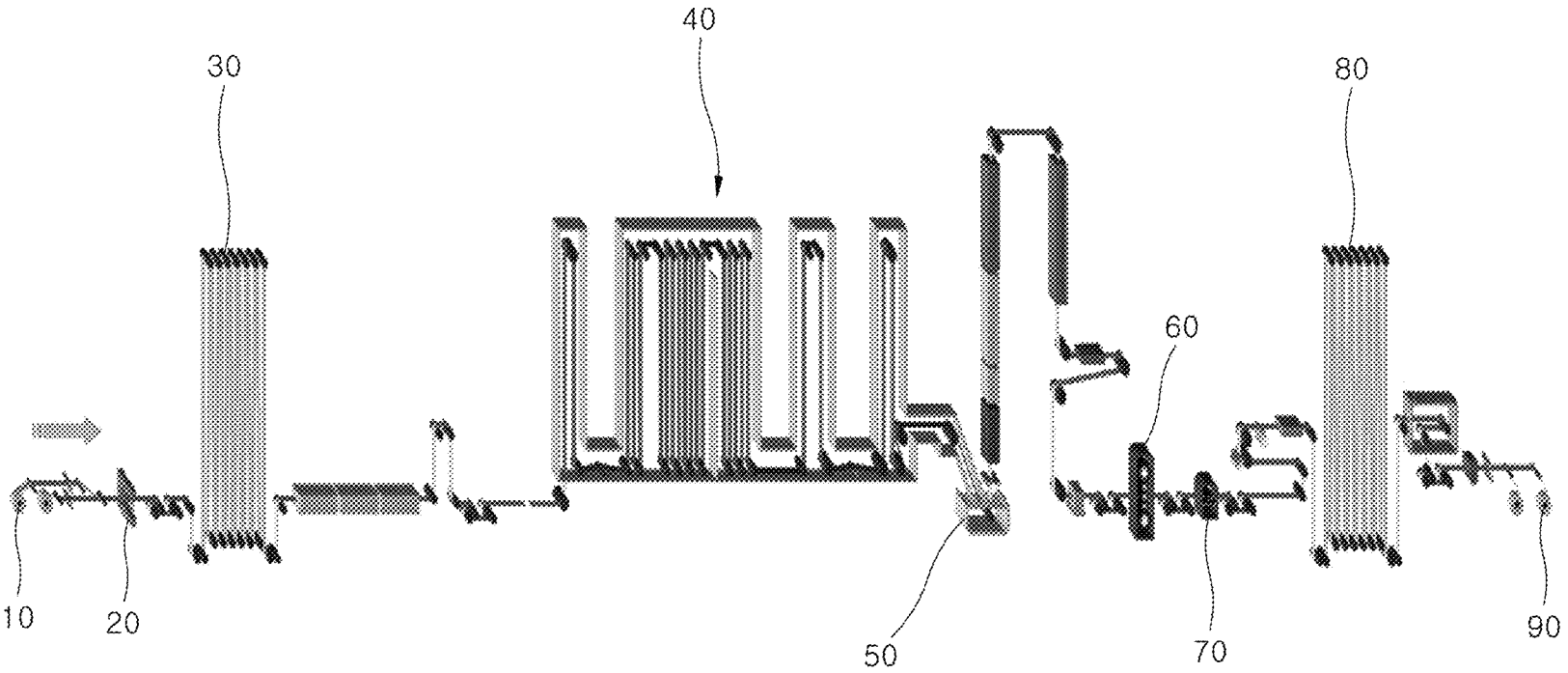
FIG. 1 illustrates a cold-rolled steel sheet production process system which is controlled by a coil width control apparatus according to an embodiment of the present invention.

Hereinafter, embodiments of a coil width control method and apparatus according to the present invention will be described with reference to the accompanying drawings. In the specification, the thickness of lines or the size of elements shown in the drawings may be exaggerated for the clarity of description and for the sake of convenience. The terms described below are defined in consideration of their function in the present invention, and the meaning of the terms may vary depending on the user's or operator's intention or usual practice. Therefore, the terms should be defined based on the contents throughout the specification.

FIG. 1 illustrates a cold-rolled steel sheet production process system which is controlled by a coil width control apparatus according to an embodiment of the present invention. The operations of a cold-rolled steel sheet production process system which is controlled by a coil width control apparatus according to an embodiment of the present invention will now be schematically described with reference to FIG. 1.

A welder 20 connects the trailing end of the preceding coil to the leading end of the trailing coil which is unwound from a payoff reel. An entry looper 30 temporarily stores the coil that goes to a heat-treatment unit (annealing furnace) 40 in order to compensate for the welding time in the welder 20. The heat-treatment unit 40 heat-treats the coil, which is transferred from the entry looper 30, to remove the internal stress of the coil and induce recrystallization. The coil from the heat treatment unit 40 is galvanized in a plating unit 50 and transferred to a post-treatment unit, and a skin pass mill 60 in the post-treatment unit tempers the surface of the coil. If controlling the tension of the coil in the post-treatment process is additionally required, as shown in FIG. 1, a tension leveler 70 for controlling the tension on the exit side of the skin pass mill 60 may also be included in the post-treatment unit. The coil from the post-treatment unit passes through an exit looper 80 and is wound around a tension reel 90.

With reference to the above-described contents and FIG. 2, a coil width control apparatus according to an embodiment of the present invention will now be described.

Figure 2:
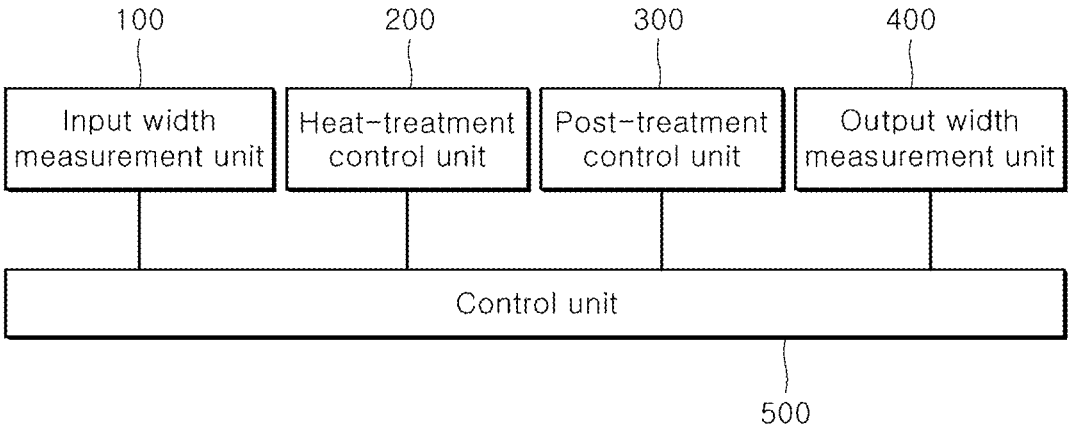
FIG. 2 is a block diagram illustrating a coil width control apparatus according to an embodiment of the present invention.

FIG. 2 is a block diagram illustrating a coil width control apparatus according to an embodiment of the present invention.

Referring to FIG. 2, a coil width control apparatus according to an embodiment of the present invention may include an input width measurement unit 100, a heat treatment control unit 200, a post-treatment control unit 300, an output width measurement unit 400, and a control unit 500.

The input width measurement unit 100 is disposed on the exit side of the entry looper 30 and may measure the input width of the coil entering the heat-treatment process and transmit the measured value to a control unit 500 to be described below. As used herein, the term "input width" is defined as meaning the width of the coil entering the heat-treatment process. The input width measurement unit 100 may include a laser sensor or a charge-coupled device (CCD) camera to measure the input width of the coil. The input width of the coil, measured by the input width measurement unit 100, may be used to predict the output width of the coil after a post-treatment process together with process conditions for a cold-rolled steel sheet production process as described below.

The heat-treatment control unit 200 may control the in-furnace temperature and in-furnace tension in the heat-treatment process by control from the control unit 500. As used herein, the expression "in-furnace temperature in the heat-treatment process" is defined as meaning the internal temperature of the heat-treatment unit 40, and the expression "in-furnace tension of the heat-treatment process" is defined as meaning a tension that is applied to the coil being heat-treated by the heat-treatment unit 40 while being transferred.

The post-treatment control unit 300 may control the elongation in the post-treatment process by control from the control unit 500. As used herein, the expression "elongation in the post-treatment process" may include coil elongation resulting from the roll force of the skin pass mill 60 in the post-treatment unit (hereinafter referred to as skin pass mill (SKM) elongation), and may also include coil elongation resulting from the roll force of the tension leveler 70 (hereinafter referred to as tension leveler (TL) elongation) if the post-treatment unit includes the tension leveler 70.

The output width measurement unit 400 may measure the output width of the coil that passed through the post-treatment process and transmit the measured value to the control unit 500. The output width measurement unit 400 may be disposed on the exit side of the post-treatment unit (or on the exit side of the skin pass mill 60 if the post-treatment unit includes only the skin pass mill 60 or on the exit side of the tension leveler 70 if the post-treatment unit includes even the tension leveler 70) or disposed on the exit side of the exit looper 80 and may measure the output width of the coil that passed through the post-treatment process. The output width measurement unit 400 may include a laser sensor or a charge-coupled device (CCD) camera to measure the output width of the coil. The actual output width of the coil, measured by the output width measurement unit 400, may be used to update a prediction model by analyzing its deviation from a predicted output width as described below.

The control unit 500 may generate a prediction model for predicting the width shrinkage of the coil, which occurs in the heat-treatment process and the post-treatment process, based on historical operating results, and may predict the output width of the coil after the post-treatment process on the basis of the input width received from the input width measurement unit 100 and cold-rolled steel sheet production process conditions, and may also control the in-furnace temperature and in-furnace tension in the heat-treatment process and the elongation in the post-treatment process based on the predicted output width and the prediction model.

As used herein, the expression "control unit 500 controls in-furnace temperature, in-furnace tension and elongation based on the predicted output width and the prediction model" means controlling in-furnace temperature, in-furnace tension and elongation through the prediction model based on the output width of the coil after the post-treatment process, predicted based on the input width input from the input measurement side 100 and based on cold-rolled steel sheet production process conditions, so that the actual output width of the coil that passed through the post-treatment process falls within a predetermined tolerance range. The tolerance range may be preset in the control unit 500 in consideration of the final width range of the coil required by the customer.

Namely, the control unit 500 is a supervisory controller for the heat-treatment control unit 200 and the post-treatment control unit 300, and may serve to control the heat-treatment control unit 200 based on the prediction model to control in-furnace temperature and in-furnace tension and control the post-treatment control unit 300 to control elongation, so that the actual output width of the coil after the post-treatment process falls within a predetermined tolerance range.

Based on the above-described configuration, a coil width control method according to an embodiment of the present invention will now be described in detail with reference to FIGS. 3 to 5.

Figure 3:
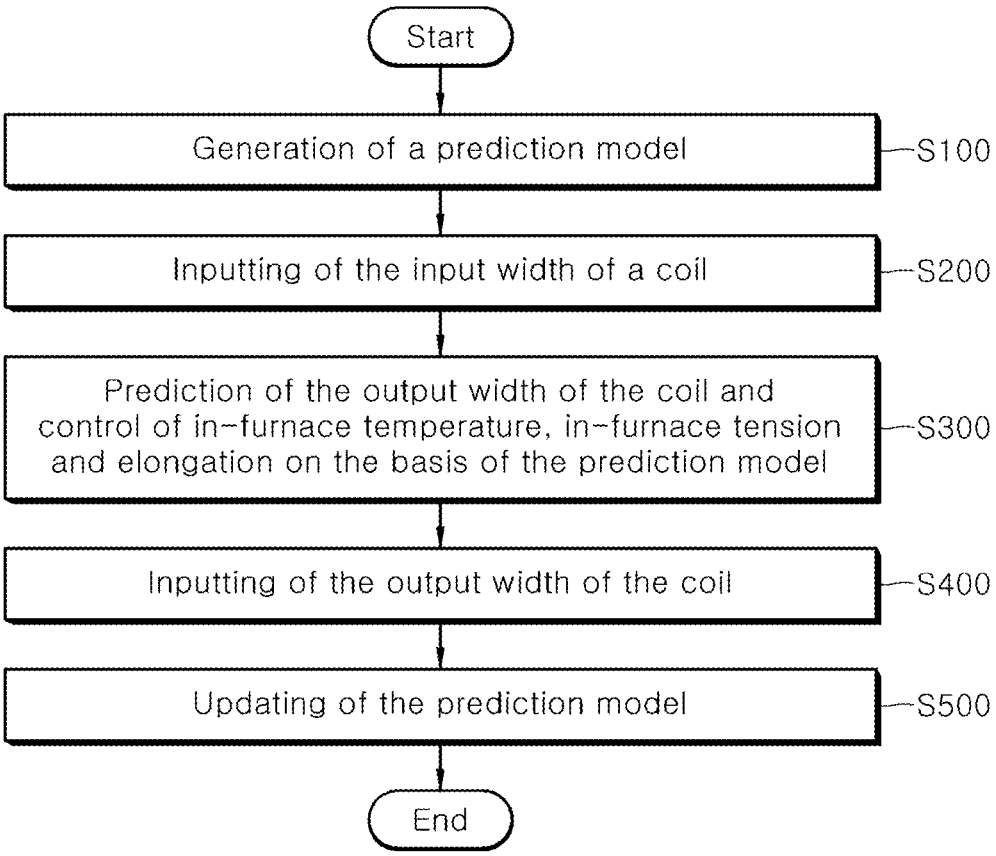
FIG. 3 is a block diagram illustrating a coil width control method according to an embodiment of the present invention.

FIG. 3 is a flow chart illustrating a coil width control method according to an embodiment of the present invention; FIG. 4 illustrates an algorithm for generating a prediction model in a coil width control method according to an embodiment of the present invention; and FIG. 5 is a flow chart specifically illustrating a process of controlling in-furnace temperature, in-furnace tension and elongation in a coil width control method according to an embodiment of the present invention.

A coil width control method according to an embodiment of the present invention will now be described with reference to FIG. 3. First, the control unit 500 generates a prediction model for predicting the width shrinkage of a coil, which occurs in the heat-treatment process and post-treatment process of a cold-rolled steel sheet production process, on the basis of historical operating results (S100).

Specifically, because the output width of a coil is determined by the input width of the coil and operating conditions, the correlation between the operating conditions and the width shrinkage of the coil can be derived on the basis of the historical operating results obtained by accumulating the input width of the coil, the operating conditions and the output width of the coil in the past cold-rolled steel sheet production process. Namely, in this embodiment, the prediction model is defined as the correlation model between the operating conditions and the width shrinkage of the coil (coil width shrinkage ratio (shrinkage ratio of output width to input width)) may also be employed), and the operating conditions may include in-furnace temperature, in-furnace tension and elongation (SPM elongation and/or TL elongation). Namely, the prediction model in this embodiment means the correlation model between in-furnace temperature, in-furnace tension, elongation and coil width shrinkage.

Figure 4:
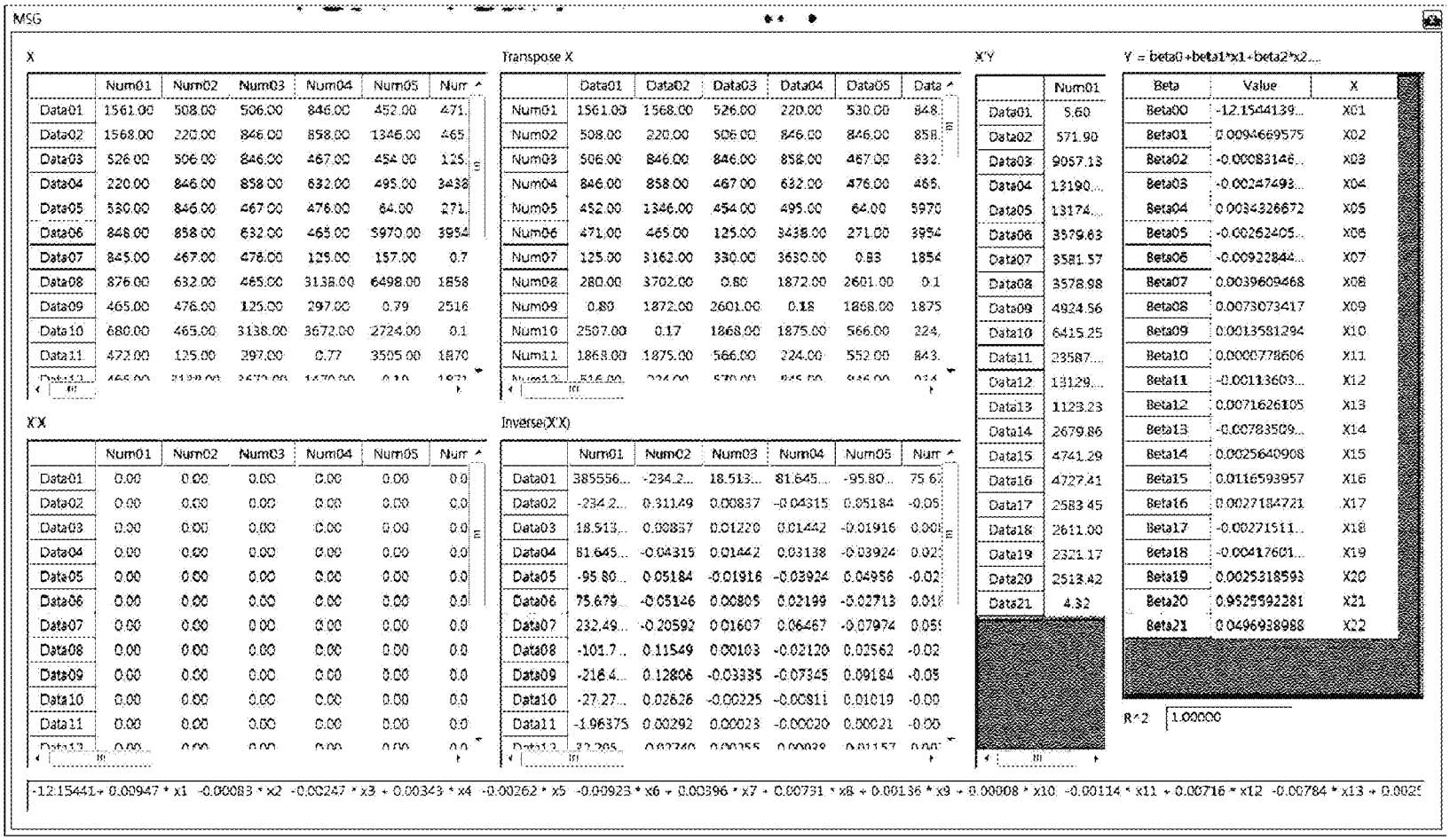
FIG. 4 illustrates an algorithm for generating a prediction model in a coil width control method according to an embodiment of the present invention.
Figure 5:
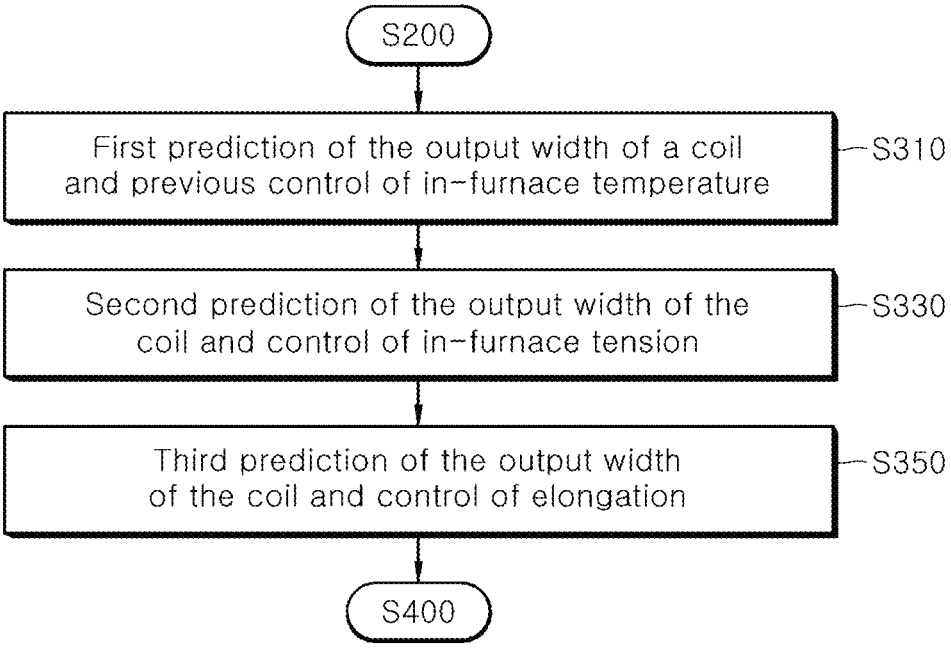
FIG. 5 is a flow chart specifically illustrating a process of controlling in-furnace temperature, in-furnace tension and elongation in a coil width control method according to an embodiment of the present invention.

In this case, the control unit 500 may generate a prediction model by regression analysis of historical operating results through a least square method, and FIG. 4 shows an algorithm for generating a prediction model.

Specifically, for the following equation 1 which is a prediction model wherein variable Y represents the width shrinkage ratio and variable x represents operating conditions, prediction coefficient ($\beta_k$) that minimizes the sum of the squares of the errors can be generated by performing multiple linear regression analysis through a least square method according to the following equation 2. The following equation 3 represents an example of a finally derived prediction model.

$$Y = \beta_0 + \beta_1 x_1 + \beta_1 x_1 + \ldots + \beta_k x_k + \varepsilon \qquad \text{Equation 1}$$

$$Q(\beta) + \sum_{i=1}^{n} \varepsilon_i^2 = \sum_{i=1}^{n} \left( y_i - \beta_0 - \sum_{j=1}^{k} \beta_j x_{ij} \right)^2 \qquad \text{Equation 2}$$

$$\begin{aligned} Y = {} & 0.02367 - 0.00037 * x1 + 0.00035 * x2 + \\ & 0.00006 * x3 + 0.00058 * x4 - 0.00009 * x5 + \\ & 0.00168 * x6 + 0.00012 * x7 - 0.00014 * x8 + \\ & 0.0006 * x9 + 0.000086 * x10 + 0.00018 * x11 + \\ & 0.00010 * x12 - 0.00181 * x13 + 0.00082 * x14 + \\ & 0.0001 * x15 - 0.00132 * x16 - 0.00111 * x17 - \\ & 0.00009 * x18 - 0.00253 * x19 + 1.06278 * x20 \end{aligned} \qquad \text{Equation 3}$$

Meanwhile, the operating conditions may include not only in-furnace temperature, in-furnace temperature and elongation, but also the transfer speed of the coil, the type of steel of the coil, etc. However, this embodiment is configured to control coil width shrinkage in the heat-treatment process and post-treatment process of the cold-rolled steel sheet production process, and thus the control unit 500 controls width shrinkage by controlling in-furnace temperature, in-furnace tension and elongation, which are controllable in the heat-treatment process and the post-treatment process, among the operating conditions of the prediction model.

As a process of producing a cold-rolled steel sheet from the coil is initiated after step S100, the control unit 500 receives the input width of the coil, which enters the heat-treatment process through an entry looper 30, from the input measurement unit 100 (S200).

Then, the control unit 500 predicts the output width after the post-treatment process on the basis of the input width received from the input measurement unit 100 and cold-rolled steel sheet production process conditions, and controls the in-furnace temperature and in-furnace tension in the heat-treatment process and the elongation in the post-treatment process on the basis of the predicted output width and the prediction model (S300). Namely, the control unit 500 predicts the output width of the coil after the post-treatment process on the basis of the input width received from the input measurement unit 100 and cold-rolled steel sheet production process conditions, and controls in-furnace temperature, in-furnace tension and elongation through the prediction model on the basis of the predicted output width so that the actual output width of the coil that passed through the post-treatment process falls within a predetermined tolerance range.

Step S300 will now be described in detail with reference to FIG. 5.

First, before the corresponding coil enters the heat-treatment process, the control unit 500 firstly predicts the output width of the corresponding coil by use of a historical database (DB) on the basis of the input width received from the input width measurement unit 100 and cold-rolled steel sheet production process conditions, and controls in-furnace temperature on the base of the firstly predicted output width and the prediction model (S310). As used herein, the term "corresponding coil" does not mean the entire coil, but means a specific position of a coil which is transferred in real time from the entry looper 30. Specifically, the term means that in-furnace temperature, in-furnace tension and elongation are controlled in order to control width shrinkage for a specific position of the coil which is transferred in real time while the specific position is tracked.

Specifically, the conditions of the cold-rolled steel sheet production process include coil information (thickness, the type of steel, etc.), and coil transfer speed, in-furnace temperature, in-furnace tension and elongation, which are conditions for performing a process of producing a cold-rolled steel sheet from the coil. Based on a historical database (DB) in which historical operating results for the output width of the coil are classified according to the type of steel and size (width and thickness) of the coil and are previously stored (or externally input) in the control unit 500 together with process conditions, the control unit 500 presets process conditions corresponding to the specification (steel type and size) of the corresponding coil, which is to enter the heat-treatment process, in the cold-rolled steel sheet production process system including the heat-treatment unit 40 and the post-treatment unit 60 or 70. Furthermore, the control unit 500 may firstly predict the output width of the corresponding coil by extracting from the historical DB the input width, received from the input width measurement unit 100, and the output width of the corresponding coil based on currently set process conditions. At this time, considering the maximum/minimum conditions of control factors such as in-furnace temperature, in-furnace tension and elongation, the output width of the corresponding coil may also firstly be predicted within the maximum/minimum ranges of the control factors.

After the output width of the corresponding coil is firstly predicted, the control unit 500 controls in-furnace temperature through the heat-treatment control unit 200 on the basis of the firstly predicted output width and the prediction model so that the actual output width of the corresponding coil after the post-treatment process falls within the tolerance range. Namely, since temperature responsiveness (which is the change in the sheet temperature of the coil with the change of the in-furnace temperature) is low, the control unit 500 controls width shrinkage by controlling the in-furnace temperature among the operating conditions of the prediction model before the corresponding coil enters the heat-treatment process, whereby the in-furnace temperature of the heat-treatment process is controlled so that the actual output width of the corresponding coil falls within the tolerance range.

After the corresponding coil enters the heat-treatment process, the control unit 500 secondly predicts the output width of the corresponding coil on the basis of the conditions of the current heat-treatment process, and controls in-furnace tension on the basis of the secondly predicted output width and the prediction model (S330).

Specifically, in step S310, the process conditions of the heat-treatment unit 40, set according to the in-furnace temperature and in-furnace tension included in cold-rolled steel sheet production process conditions, may change due to previous control of the in-furnace temperature or depending on process circumstances, and for this reason, the control unit 500 may secondly predict the output width of the corresponding coil by extracting from the historical DB the output width of the corresponding coil for current heat-treatment process conditions.

After the output width of the corresponding coil is secondly predicted, the control unit 500 controls in-furnace tension through the heat-treatment control unit 200 on the basis of the secondly predicted output width and the prediction model, so that the actual output width of the corresponding coil after the post-treatment process falls within the tolerance range. Namely, the control unit 500 controls width shrinkage by controlling the in-furnace tension of the heat-treatment process among the operating conditions of the prediction model so that the actual output width of the corresponding coil falls within the tolerance range.

After the corresponding coil passes through the heat-treatment process, the control unit 500 thirdly predicts the output width of the corresponding coil on the basis of the conditions of the current post-treatment process, and controls elongation on the basis of the thirdly predicted output width and the prediction model (S350).

Specifically, in step S310, the process conditions of the post-treatment units 60 and 70, set according to the elongation included in cold-rolled steel sheet production process conditions, may change depending on process circumstances, and for this reason, the control unit 500 may thirdly predict the output width of the corresponding coil by extracting from the historical DB the output width of the corresponding coil on the basis of current post-treatment process conditions.

After the output width of the corresponding coil is thirdly predicted, the control unit 500 controls elongation through the post-treatment control unit 300 on the basis of the thirdly predicted output width and the prediction model so that the actual output width of the corresponding coil falls within the tolerance range. Namely, the control unit 500 controls width shrinkage by controlling elongation of the post-treatment process among the operating conditions of the prediction model so that the actual output width of the corresponding coil falls within the tolerance range.

Meanwhile, in step S350, the control unit 500 may also control elongation by sequentially controlling the roll force of the skin pass mill 60 and the roll force of the tension leveler 70.

Namely, where the post-treatment unit includes both the skin pass mill 60 and the tension leveler 70 as described above, coil surface tempering by the skin pass mill 60 and tension control by the tension leveler 70 may be sequentially performed in the post-treatment process.

Accordingly, after the corresponding coil passes through the heat-treatment process, the control unit 500 may thirdly predict the output width of the corresponding coil on the basis of current post-treatment process conditions (prediction stage 3.1), and may control the roll force of the skin pass mill (i.e. SPM elongation) on the basis of the output width predicted in prediction state 3.1 and the prediction model so that the actual output width of the corresponding coil after the post-treatment process falls within the tolerance range. Furthermore, after the roll force of the skin mass mill 60 is controlled, the control unit 500 may thirdly predict the output width of the corresponding coil on the basis of current post-treatment process conditions (prediction stage 3.2), and may control the roll force of the tension leveler 70 (i.e., TL elongation) on the basis of the output width predicted in prediction stage 3.1 and the prediction model so that the actual output width of the corresponding coil after the post-treatment process falls within the tolerance range.

Through step S310, step S330 and step S350, the control unit 500 may predict the output width of the corresponding coil for current process conditions in each step, and control controllable operating conditions in each step on the basis of the prediction model, thereby more accurately controlling the width shrinkage of the coil.

After in-furnace temperature, in-furnace tension and elongation are controlled by step S300 and the corresponding coil passes through the post-treatment process, the control unit 500 receives the actual output width of the corresponding coil, which passed through the post-treatment process, from the output width measurement unit 400 (S400).

Then, the control unit 500 updates the prediction model on the basis of the deviation between the output width predicted in step S300 and the actual output width received from the output width measurement unit 400 in step S400 (S500). Specifically, the control unit 500 updates the prediction model by accumulating the deviation between the output width predicted in step S300 and the actual output width and analyzing the variance of the accumulated deviation to update the prediction coefficient of the prediction model. Namely, the deviation between the actual output width and the output width predicted in the step S300 indicates the accuracy of controlling in-furnace temperature, in-furnace tension and elongation on the basis of the prediction model, and thus the control unit 500 can update the prediction model by determining a weight according to the magnitude of the variance and applying (adding or multiplying) the weight to the prediction coefficient. At this time, the control unit 500 can calculate the deviation between the actual output width and the output width predicted in step S350 (i.e., the output width predicted in prediction stage 3.1 or the output width predicted in prediction stage 3.2) among the output widths predicted in step S300. Namely, the deviation between the actual output width and the output width predicted in the elongation control step of the final control step S350 reflects the accuracy of control of elongation and also reflects the accuracy of control of in-furnace temperature and in-furnace tension in step S310 and step S330 which are the preceding steps, and thus the control unit 500 can update the prediction model on the basis of the deviation between the output width predicted in step S350 and the output width received from the output width measurement unit 400 in step S400.

If the variance derived in step S500 exceeds a preset reference value, the control unit 500 may regenerate the prediction model. The reference value is an upper limit value of the variance that can be used to determine that the prediction model is unreliable, and it means a parameter previously set in the control unit 500.

On the basis of the above-described contents, the above-described embodiment will now be described by way of specific example.

Figure 6:
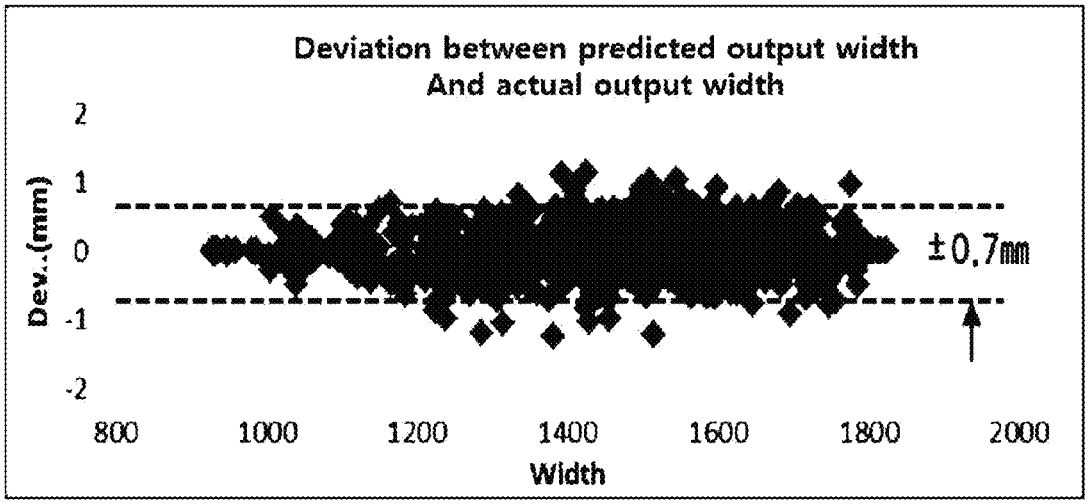
FIG. 6 is a graph showing the results of measuring the deviation between predicted output width and actual output width in a coil width control method according to an embodiment of the present invention.

Table 1 below shows the control range for each of the in-furnace temperature and in-furnace tension in the heat-treatment process and the elongation in the post-treatment process, which are actually applied in the cold-rolled steel sheet production process, and shows IQR (InterQuartile Range), which is the range between the third and first quartiles of the overall control range. In the control ranges shown in Table 1 below, when the prediction model according to equation 1 was generated by regression analysis of the historical operating results, obtained by accumulating the results for the coil input width, operating conditions and coil output width in the past cold-rolled steel sheet production process, through the least square method according to equation 2, the prediction coefficient for each of in-furnace temperature, in-furnace tension, SPM elongation and TL elongation was derived as shown in Table 1 below. A prediction model was generated for each of the cases in which yield point (YP) or yield strength for confirming the reliability of the prediction model is 190 MPa (YP19), 192 MPa (YP19.2), 193 MPa (YP19.3), 291 MPa (YP29.1) and 430 MPa (YP43). FIG. 6 is a graph showing the deviation the actual output width and the output width predicted by controlling in-furnace temperature, in-furnace tension and elongation through the prediction model. Referring to FIG. 6, it can be seen that 90% or more of the deviations between the predicted output widths and the actual output widths lie within the range of ±0.7 mm, which is the RMS average value for the input and output width control standards, suggesting that the prediction model of this embodiment is highly reliable.

TABLE 1

| | Control range | | | | Prediction coefficient (β) | | | |
|---|---|---|---|---|---|---|---|---|
| Yield strength | In-furnace temperature (° C.) | In-furnace tension (kg) | SPM elongation (%) | TL elongation (%) | In-furnace temperature | In-furnace tension | SPM elongation | TL elongation |
| YP19 | ±10 | ±111 | ±0.02 | 0-0.02 | 0.0006424 | 0.000169 | 0.0994775 | 0.6701814 |
| YP19.2 | ±10 | ±24 | ±0.02 | 0-0.02 | 0.0009581 | 0.0002128 | 0.1665089 | 0.5625182 |
| YP19.3 | ±10 | ±64 | ±0.02 | 0-0.02 | 0.000593 | 0.0001613 | 0.1997561 | 0.5937593 |
| YP29.1 | ±10 | ±73 | ±0.18 | 0-0.02 | 0.0006977 | 0.0002406 | 0.0962992 | 0.397929 |
| YP43 | ±10 | ±290 | ±0.19 | 0-0.02 | 0.0020646 | 0.0001275 | 0.0616989 | 0.2854343 |

Table 2 below the width control (width shrinkage and width spread) measured when the in-furnace temperature and in-furnace tension in the heat-treatment process and the elongation in the post-treatment process were controlled on the basis of the prediction models according to Table 2 (i.e., the prediction models having the prediction coefficients shown in Table 1). Since the post-treatment unit may include not only the skin mass mill 60 but also the tension leveler 70 as described above, the width control is shown for two different cases: one case in which elongation is controlled using the skin pass mill 60 alone; and another case in which elongation is controlled using the skin pass mill 60 together with the tension leveler 70. The width control in the case in which the tension leveler 70 is not used (non-use of TL in Table 2) indicates the width control by transfer rolls located on the exit side of the skin pass mill 60. Meanwhile, in Table 2, coil width (i.e., input width) was set at 1517.7 mm, and the symbols (−) and (+) represent width shrinkage and width spread, respectively.

TABLE 2

| | Width control (mm) for each item | | | | |
|---|---|---|---|---|---|
| Yield strength | In-furnace temperature | In-furnace tension | SPM elongation | Non-use of TL | TL elongation |
| YP19 | ±0.09749 | ±0.284759 | ±0.030195 | −0.203427 | −2.034268 |
| YP19.2 | ±0.145412 | ±0.077526 | ±0.050542 | −0.170747 | −1.707468 |
| YP19.3 | ±0.089998 | ±0.156705 | ±0.060634 | −0.18023 | −1.802297 |
| YP29.1 | ±0.105889 | ±0.266518 | ±0.263076 | −0.120787 | −1.207874 |
| YP43 | ±0.313351 | ±0.56124 | ±0.177917 | −0.086641 | −0.866407 |
| Average | ±0.150428 | ±0.26935 | ±0.116473 | −0.152366 | −1.523663 |

Tables 1 and 2 above show the case in which the yield strength is 190 MPa (YP19) and in which the tension leveler 70 is not used. In this case, when in-furnace temperature, in-furnace tension and SPM elongation are controlled through the prediction models according to prediction coefficients of 0.0006424, 0.000169 and 0.0994775 in the control ranges (±10° C., ±111 kg, and ±0.02%), they show width controls of ±0.09749 mm, ±0.284759 mm and ±0.030195 mm, respectively, and the width control by the transfer rolls located on the exit side of the skin pass mill 60 is shown to be −0.203427 mm, and thus the total width control is about −0.62 to +0.41 mm. Here, it is assumed that the tolerance range is set to 1510 mm to 1515 mm.

Assuming that the output width of the coil is firstly predicted to be 1515.5 mm through a historical DB when the input width of the coil is 1517.7 mm, a width spread of 0.5 mm or more is required so that the firstly predicted output width of the coil falls within the tolerance range. This width spread corresponds to a width control amount controllable according to −0.62 to +0.41 mm, which is the total width control range according to Table 2, and thus the control unit 500 controls in-furnace temperature through the prediction models having the in-furnace temperature prediction coefficients according to Table 1 so that the output width of the coil after the post-treatment process falls within the tolerance range.

Meanwhile, assuming that the output width of the coil is firstly predicted to be 1509.8 mm through the historical DB, a width spread of 0.2 mm or more is required so that the firstly predicted output width of the coil falls within the tolerance range. This width spread corresponds to a width control amount controllable according to −0.62 to +0.41 mm, which is the total width control range according to Table 2, and thus the control unit 500 controls in-furnace temperature through the prediction models having the in-furnace temperature prediction coefficients according to Table 1 so that the output width of the coil after the post-treatment process falls within the tolerance range.

The above-mentioned process is also applicable to a process of secondly and thirdly predicting the output width of the coil and controlling in-furnace tension and elongation on the basis of the predicted output widths so that the output width of the coil after the post-treatment process falls within the tolerance range.

Meanwhile, in the case in which the tension leveler 70 is used as shown in Tables 1 and 2, in-furnace temperature, in-furnace tension and elongation are controlled in the same manner as the above-described process. Namely, in the case in which the yield strength is 190 MPa (YP19), when in-furnace temperature, in-furnace tension, SPM elongation and TL elongation are controlled through the prediction models according to the prediction coefficients (0.0006424, 0.000169, 0.0994775, and 0.6701814) in the control ranges (±10° C., ±111 kg, ±0.02%, and 0-0.02%) shown in Table 1, they show width controls of ±0.09749 mm, ±0.284759 mm, ±0.030195 mm, and −2.034268 mm, respectively, and thus the total width control is about −2.45 to +0.41 mm. Based on this width control, the control unit 500 controls in-furnace temperature, in-furnace tension and elongation through the prediction models so that the output width of the coil after the post-treatment process falls within the tolerance range.

In the case in which the yield strength is 190 MPa (YP19), when the tension leveler 70 is not used, the total width control is about −0.62 to +0.41 mm, and when the tension leveler 70 is used, the total width control is about −2.45 to +0.41 mm. This suggests that when elongation is controlled using the tension leveler 70, the range of the width of the coil, which can be controlled using the prediction model, is expanded. The effect of elongation control will now be described in detail with reference to Table 3 below.

Table 3 below compares the case in which only in-furnace temperature and in-furnace tension are controlled with the case in which the elongation in the post-treatment process is additionally controlled.

TABLE 3

| | Items to be controlled: In-furnace temperature and in-furnace tension | | Items to be controlled: In-furnace temperature, in-furnace tension and SPM elongation | | Items to be controlled: In-furnace temperature, in-furnace tension, SPM elongation and TL elongation | | Effect of control of SPM elongation | | Effect of control of TL elongation | |
|---|---|---|---|---|---|---|---|---|---|---|
| Yield strength | Width shrinkage | Width spread | Width shrinkage | Width spread | Width shrinkage | Width spread | Width shrinkage | Width spread | Width shrinkage | Width spread |
| YP19 | −0.38 | 0.38 | −0.62 | 0.41 | −2.45 | 0.41 | −0.24 | 0.03 | −2.07 | 0.03 |
| YP19.2 | −0.22 | 0.22 | −0.44 | 0.27 | −1.98 | 0.27 | −0.22 | 0.05 | −1.76 | 0.05 |
| YP19.3 | −0.25 | 0.25 | −0.49 | 0.31 | −2.11 | 0.31 | −0.24 | 0.06 | −1.86 | 0.06 |
| YP29.1 | −0.37 | 0.37 | −0.76 | 0.64 | −1.84 | 0.64 | −0.39 | 0.27 | −1.47 | 0.27 |

TABLE 3-continued

| | Items to be controlled: In-furnace temperature and in-furnace tension | | Items to be controlled: In-furnace temperature, in-furnace tension and SPM elongation | | Items to be controlled: In-furnace temperature, in-furnace tension, SPM elongation and TL elongation | | Effect of control of SPM elongation | | Effect of control of TL elongation | |
|---|---|---|---|---|---|---|---|---|---|---|
| Yield strength | Width shrinkage | Width spread | Width shrinkage | Width spread | Width shrinkage | Width spread | Width shrinkage | Width spread | Width shrinkage | Width spread |
| YP43 | −0.87 | 0.87 | −1.14 | 1.05 | −1.92 | 1.05 | −0.27 | 0.18 | −1.05 | 0.18 |
| Average | −0.42 | 0.42 | −0.69 | 0.54 | −2.06 | 0.54 | −0.27 | 0.12 | −1.64 | 0.12 |

The case in which the yield strength is 190 MPa (YP19) will now be described by way of example. When a prediction model is applied considering only in-furnace temperature and in-furnace tension, the width control in the range of −0.38 to +0.38 mm as shown in Table 3 is predicted. This suggests that when only the in-furnace temperature and in-furnace tension in the heat-treatment process are controlled, the range of the width of the coil, which can be controlled based on the prediction model, is limited to the range of −0.38 to +0.38 mm.

When the prediction model is applied considering SPM elongation in addition to in-furnace temperature and in-furnace tension, the width control in the range of −0.62 to +0.41 mm as shown in Table 3 is predicted. This suggests that when SPM elongation is further controlled in addition to in-furnace temperature and in-furnace tension, the range of the width of the coil, which can be controlled based on the prediction model, can be expanded compared to when only in-furnace temperature and in-furnace tension are controlled. Namely, when SPM elongation is further controlled in addition to in-furnace temperature and in-furnace tension, the range of the width of the coil, which can be controlled based on the prediction model, can be increased by −0.24 to +0.03 mm as shown in "Effect of control of SPM elongation" in Table 3 above.

Furthermore, when the prediction model is applied considering TL elongation, the width control in the range of −2.45 to +0.41 mm as shown in Table 3 is predicted. This suggests that when TL elongation is further controlled in addition to in-furnace temperature and in-furnace tension, the range of the width of the coil, which can be controlled based on the prediction model, is expanded. Namely, when TL elongation is further controlled in addition to in-furnace temperature and in-furnace tension, the range of the width of the coil, which can be controlled based on the prediction model, can be increased by −2.07 to +0.03 mm as shown in "Effect of control of TL elongation" in Table 3 above.

As described above, according to the embodiment of the present invention, the width shrinkage in the cold-rolled steel sheet production process can be predicted based on the prediction model which is the correlation model between operating conditions and coil width shrinkage, and operating conditions can be automatically controlled based on the predicted width shrinkage, thereby controlling the coil width shrinkage in process procedures. As a result, the production of products that satisfy the standards required by the customer can be increased, making it possible to ensure the yield, and the cost loss resulting from the processing of a material having an insufficient width and a material having an excessive width can be reduced.

While the present invention has been described in connection with the specific embodiments illustrated in the drawings, these embodiments are illustrative only. Those skilled in the art will appreciate that various modifications and other equivalent embodiments are possible from the above-described embodiments. Therefore, the true technical scope of the present invention should be defined by the appended claims.

What is claimed is:

1. A coil width control method comprising:

generating, using a control unit, a prediction model for predicting a width shrinkage of a coil, which occurs in a heat-treatment process and post-treatment process of a cold-rolled steel sheet production process, on the basis of historical operating results;

receiving, using the control unit, an input width of the coil entering the heat-treatment process;

predicting, using the control unit, an output width of the coil, after the post-treatment process, on the basis of the received input width and operating conditions of the cold-rolled steel sheet production process; and controlling, using the control unit, in-furnace temperature and in-furnace tension of the heat-treatment process and elongation of the coil caused by the post-treatment process as a function of the predicted output width.

2. The coil width control method of claim 1, wherein the prediction model is a correlation model between operating conditions and coil width shrinkage, generated by performing regression analysis of the operating conditions through a least square method, wherein the operating conditions include the in-furnace temperature, the in-furnace tension and the elongation of the coil caused by the post-treatment process.

3. The coil width control method of claim 2, wherein controlling the in-furnace temperature and in-furnace tension of the heat-treatment process and the elongation of the coil caused by the post-treatment process comprises:

firstly predicting, using the control unit, the output width of a specific position of the coil on the basis of the received input width and the operating conditions of the cold-rolled steel sheet production process by use of a historical database (DB);

controlling, using the control unit, the in-furnace temperature on the basis of the firstly predicted output width and the prediction model, before the specific position of the coil enters the heat-treatment process;

secondly predicting, using the control unit, the output width of the specific position of the coil on the basis of current heat-treatment process conditions;

controlling, using the control unit, the in-furnace tension on the basis of the secondly predicted output width and the prediction model, after the specific position of the coil enters the heat-treatment process; and thirdly predicting, using the control unit, the output width of the specific position of the coil on the basis of current post-treatment process conditions; and controlling, using the control unit, the elongation of the coil on the basis of the thirdly predicted output width and the prediction model, after the specific position of the coil passes through the heat-treatment process.

4. The coil width control method of claim 3, wherein controlling the elongation of the coil includes sequentially controlling a roll force of a skin pass mill and a roll force of a tension leveler.

5. The coil width control method of claim 1, further comprising:

receiving, using the control unit, an actual output width of the coil that passed through the post-treatment process; and updating using the control unit, the prediction model on the basis of a deviation between the predicted output width and the received actual output width.

6. A coil width control apparatus comprising:

an input width measurement unit configured to measure an input width of a coil entering a heat-treatment process in a cold-rolled steel sheet production process, the cold rolled sheet production process including the heat-treatment process and a post-treatment process;

a heat-treatment control unit configured to control in-furnace temperature and in-furnace tension of the heat-treatment process;

a post-treatment control unit configured to control elongation of the coil caused by the post-treatment process; and a control unit configured to generate a prediction model for predicting a width shrinkage of the coil, which occurs in the heat-treatment process and the post-treatment process, on the basis of historical operating results, the control unit predicting an output width of the coil after the post-treatment process on the basis of the input width received from the input width measurement unit and operating conditions of the cold-rolled steel sheet production process, and controlling the in-furnace temperature and the in-furnace tension through the heat-treatment control unit on the basis of the predicted output width and the prediction model, and controlling the elongation through the post-treatment control unit.

7. The coil width control apparatus of claim 6, wherein the control unit is configured to:

firstly predict the output width of a specific position of the coil on the basis of the received input width and the operating conditions of the cold-rolled steel sheet production process by use of a historical database (DB);

control the in-furnace temperature through the heat-treatment control unit on the basis of the firstly predicted output width and the prediction model, before the specific position of the coil enters the heat-treatment process;

secondly predict the output width of the specific position of the coil on the basis of current heat-treatment process conditions;

control the in-furnace tension through the heat-treatment control unit on the basis of the secondly predicted output width and the prediction model, after the specific position of the coil enters the heat-treatment process; and thirdly predict the output width of the specific position of the coil on the basis of current post-treatment process conditions; and control the elongation of the coil through the post-treatment control unit on the basis of the thirdly predicted output width and the prediction model, after the specific position of the coil passes through the heat-treatment process.

8. The coil width control apparatus of claim 6, further comprising an output width measurement unit configured to measure the output width of the coil that passed through the post-treatment process, wherein the control unit is configured to receive the actual output width of the coil, which passed through the post-treatment process, from the output width measurement unit, and update the prediction model on the basis of a deviation between the predicted output width and the received actual output width.

* * * * *